US006558144B1

(12) United States Patent
Gueydan et al.

(10) Patent No.: US 6,558,144 B1
(45) Date of Patent: May 6, 2003

(54) METAL POWDER COMPRESSION TOOL

(75) Inventors: Henri Gueydan, Moirans (FR); Pierre Blanchard, Dayton, OH (US)

(73) Assignee: Federal-Mogul Sintered Products, S.A., Veurey-Voroise (FR)

( * ) Notice: Subject to any disclaimer, the term of this patent is extended or adjusted under 35 U.S.C. 154(b) by 0 days.

(21) Appl. No.: 09/463,682

(22) PCT Filed: Jul. 23, 1998

(86) PCT No.: PCT/EP98/04932

§ 371 (c)(1),
(2), (4) Date: Apr. 13, 2000

(87) PCT Pub. No.: WO99/06167

PCT Pub. Date: Feb. 11, 1999

(30) Foreign Application Priority Data

Jul. 29, 1997 (FR) ..... 97 09918

(51) Int. Cl.[7] ..... B22F 3/82; B22F 3/12
(52) U.S. Cl. ..... 425/78
(58) Field of Search ..... 419/37, 38, 39; 75/231; 425/78

(56) References Cited

U.S. PATENT DOCUMENTS 5,594,186 A * 1/1997 Krause et al. ..... 75/228
5,602,350 A * 2/1997 German et al. ..... 75/231
5,694,640 A * 12/1997 Greetham ..... 419/38
5,754,937 A * 5/1998 Jones et al. ..... 419/38
5,926,686 A * 7/1999 Engstrom et al. ..... 419/37

FOREIGN PATENT DOCUMENTS

| | | |
|---|---|---|
| DE | 3115470 | 1/1982 |
| JP | 06041603 | 2/1994 |
| JP | 06218587 | 8/1994 |

OTHER PUBLICATIONS

Burns, Robert, "production presses and tooling" Metals Handbook vol. 7: Powder Metallurgy, 1984, pp. 329–338, XP–002062368, Ohio US.

Bockstiegel, G. et al., "The Influence of lubrication, die material and tool design upon die wear in the compacting of iron powders", Modern Developments in Powder Metallurgy, Proceedings of the 1970 International Powder Metallurgy Conference, vol. 4, 1971, pp. 87–114, XP002062367, New York London.

* cited by examiner

*Primary Examiner*—Daniel J. Jenkins
(74) *Attorney, Agent, or Firm*—Howard & Howard

(57) ABSTRACT

The present invention relates to a metal powder compression tool for forming compacts for sintering, including a first punch (15) adapted to compress powder located in a die (10). The clearance between the punch and the die is greater than the radial expansion of the punch under the desired compression effort, and lower than the mean size of the powder grain.

16 Claims, 3 Drawing Sheets

METAL POWDER COMPRESSION TOOL

The present invention relates generally to the manufacture of articles by sintering techniques and more specifically to a powder compression tool for forming a work piece herein termed a compact, which is then placed in a sintering furnace.

BACKGROUND OF THE INVENTION

In general terms, sintering consists of compressing metal powder, generally a steel powder, to obtain a compact of definitive shape. This compact whose shape is maintained only by cohesion of the powder, is then passed through a furnace at a sintering temperature below the melting temperature, but sufficient for the powder particles to join.

After sintering, the product will typically exhibit a final density which approaches, but does not equal the density of the metal in question. In the case of steel powder, it is possible to achieve final densities on the order of 7.4–7.5 g/cc, using the conventional pressing and sintering techniques described below, whereas the density of steel itself is on the order of 7.8–7.9. For ease of reference, this will be referred to as the maximum density.

SUMMARY OF THE INVENTION

It is an object of the present invention to provide a modified pressing process and apparatus capable of operation to yield sintered products having a final sintered density which more nearly approaches the maximum density of the material, and in the case of steel, a final sintered density of over 7.5. According to the present invention, this is achieved by a single press, single sinter process in which a metal powder mix containing from about 0.3 to 0.5 weight % of a solid lubricant is pressed in a single step in a die having a working clearance of at least 45 $\mu$m under a pressure of at least 800 MPa to form a compact for subsequent sintering.

For better understanding of the basic technology, conventional powder compression processes will now be described with the aid of FIGS. 1A, 1B and 1C.

Figure 1A:
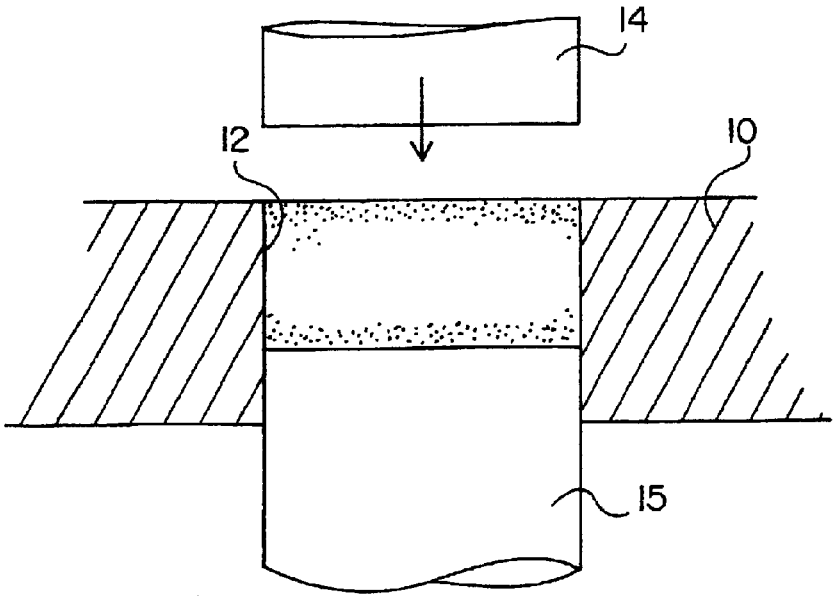
Figure 1B:
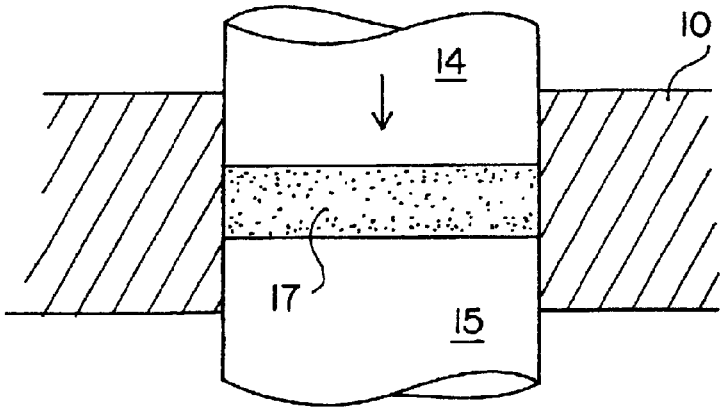
Figure 1C:
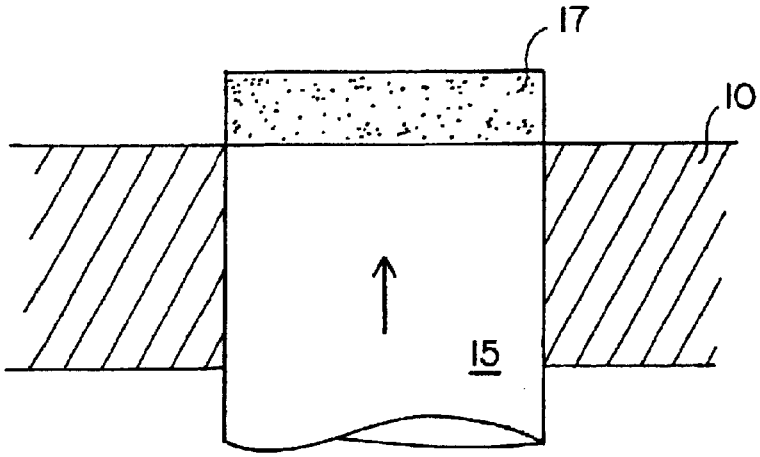

FIGS. 1A to 1C illustrate the operation of a powder compression tool. The tool includes a die 10 with a cavity 12 arranged through it. This cavity 12 defines the shape or profile of the desired compact, including features such as a smooth surface, an indentation, or other characteristic. Die 10 co-operates with an upper punch 14 and a lower punch 15 which penetrate through both ends of the cavity 12.

In FIG. 1A, the cavity 12 is filled with metal powder flush with the upper surface of die 10. Lower punch 15 is at a specific position determined by the volume of powder required to obtain the desired height and density of the final produce Once cavity 12 is filled with powder, upper punch 14 is lowered.

In FIG. 1B, upper punch 14 reaches an end position determined by the pressure applied to both punches. A compact 17 of desired shape is then obtained in cavity 12, formed of powder particles sufficiently cohered together to allow it to be handled and carried to a sintering furnace (not shown).

In FIG. 1C, upper punch 14 is withdrawn while lower punch 15 is raised to eject compact 17 from the cavity 12. The compact is then carried to the sintering furnace. To eject Impact 17, instead of raising the punch 15, die 10 could be lowered. It will be appreciated that various options are possible.

As illustrated in FIGS. 1A and 1B, the volume of the powder decreases considerably on application of pressure.

For conventional pressures, on the order of 700 MPa. the volume decreases by a factor 2.3 to 2.5. This decrease in volume is accompanied by rubbing of the powder against the wails of the cavity 12 over the length of travel of the punch. It is thus essential to lubricate the walls of the cavity 12 to minimise friction.

Lubrication of the walls of the cavity 12 being impractical in production, it is preferred to include the lubricant in the metal powder. For the powder to be able to properly flow to fill up the cavity, the lubricant also comes as a powder.

Of course, lubrication also facilitates ejection of the compact 17, without damage.

The proportion of lubricant commonly used in the metal powder is from 0.6 to 0.8% in weight. However, the lubricant is about eight times less dense that the metal powder, and occupies an incompressible volume which cannot be replaced by metal during the compression. As a result, especially upon elimination of the lubricant while sintering. the obtained compacts are porous and have a mechanical strength which is substantially lower than that of pure metal.

Thus in practical terms, conventional pressing and sintering processes can yield products with a final density (in the case of steel) of up to 7.5. More typically, using a pressure of 700 MPa and 0.8% lubricant, the final density is only around 7.15. In theory, higher pressures would tend to increase the final density, but in practice, pressures exceeding about 800 MPa have been observed to result in rapid tool damage, even though the tool itself is, in isolation, capable of withstanding more than 2000 MPa.

It is appropriate to mention that final sintered density is much more significant than the so-called "theoretical maximum density" of the compact, including lubricant, before sintering. Reducing the lubricant quantity may make it possible to achieve a higher percentage of the maximum theoretical density of a particular metal powder/lubricant mixture, but even values such as 96% of maximum theoretical density correspond only to a final sintered density of 7.15 in the case of steel powder containing 0.8% lubricant.

A final density, in the case of steel powder, of around 7.15 thus is typical of that obtained through a conventional single press/single sinter process, in which a single powder compression step is performed, at about 700 MPa, followed by sintering to obtain the final product.

To obtain sintered compacts with higher densities, a double press/double sinter process can be used, in which, after compression under the above-mentioned conditions, the compact undergoes a pre-sintering treatment to vaporise the lubricant, so as to empty the pores that it occupies. The compact is then submitted, before a final sintering, to a second compression during which the material, not yet generally integral, tends, through plastic deformation, to occupy the empty pores. With such a process, however, final densities above 7.5 cannot be achieved. Further, such a two-stage process is more expensive to implement than a single press/single sinter process.

There is also a warm forming process in which the die and powder are heated to about 100–150° C. to liquefy the lubricant which then escapes by draining from the pores. The maximum densities obtained are on the order of 7.4 (in the case of steel) and the process is also expensive to implement.

A further object of the present invention is to provide a compression tool which can more successfully withstand operation at higher than normal pressures.

Yet another object of the present invention is to provide such a tool which enable compacts of particularly high final density to be obtained through a single pressing process.

In conventional compression tools, the clearance between punches and dies has always been made as small as possible. This is to avoid or at least minimise extension of powder through the clearance, as well as the formation of moulding flash, generally referred to as "beards". The clearance commonly found in typical tools ranges from 10 to 20 μm.

Figure 2:
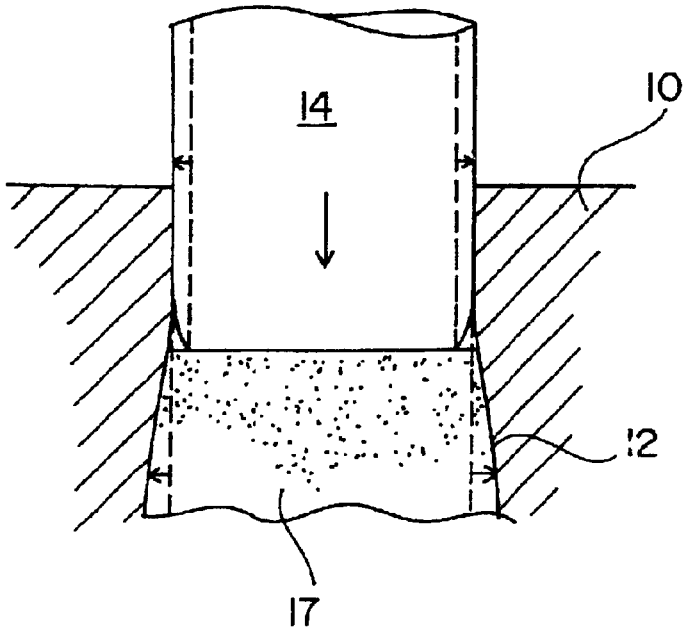

FIG. 2 illustrates on an enlarged scale the clearance in the tool and the deformation which take place during a compression operation. The nominal diameters of moving punch 14 and of cavity 12 of the die are indicated in dotted lines. During compression, punch 14 tends to undergo barrel deformation. At a certain pressure level, the punch comes into contact with the die along As entire circumference while still moving. The resulting friction increases as punch 14 comes closer to its final position and the deformation also increases.

If the friction were uniform over the punch circumference, the tool would be able to better withstand high pressure. However, in practice, punch 14 always rubs more against one side than against the other, which causes a high bending stress in the punch and even in the die. The compression tool, which is designed primarily for hardness, poorly withstands bending stress and prematurely deteriorates if the pressure exceeds 800 MPa.

Of course. the friction of punch 14 against die 10 may also damage the surface finish of the cavity 12, making the subsequent ejection of the compact 17 more difficult and affecting in turn its surface finish and that of components subsequently pressed in the die.

As shown in FIG. 2, the compact 17 itself also tends to undergo barrel deformation when under compression. pushing against the side walls of the cavity 12. When the punch is withdrawn, the compact 17 and the walls of cavity 12 may, if excessive force has been applied, undergo permanent deformation, making the ejection of the compact more difficult. This ejection is normally facilitated by the presence of a sufficient amount of lubricant, of course.

To avoid or at least minimise the above-mentioned problems, the present invention provides an increased clearance between the elements of the tool, especially between the moving punch and the die, so that this clearance is not affected by any deformation of the elements during the compression operation. The presence of a clearance may tend to accentuate the generation of beards on the edges of the produced compacts, but such beards only affects, for the most part the aesthetic appearance of the compacts. The increased clearance is preferably not greater than the mean grain size of the powder, or else the powder grains will tend to jam together in the gap, thereby increasing friction as well as causing excessive loss of powder, in an extreme case.

The article by G Bockstiegel et al: "The influence of lubrication, die material and tool design upon die wear in the compacting of iron powders", Modem Developments in Powder Metallurgy, Proceedings of the 1970 International Powder Metallurgy Conference, vol. 4, 1971, New York, London, describes experiments made with punch/die clearances of 5, 10, 25 and 45 μm, and concludes that the use of large clearances is detrimental in terms of tool wear.

In contrast the present invention uses large clearances, in particular greater than 45 μm.

According to one embodiment of the present invention, the elements of the tool are arranged to form a compact having one face flush with a surface of the die.

According to another embodiment of the present invention, the tool includes a second punch (15, 14) co-operating with the cavity (12) from the side opposite to the point of entry of the first punch, the second punch, during compression, being arranged to seal the cavity at or in the vicinity of the die surface, the first punch being used to eject the compact at the end of compression.

According to another embodiment of the present invention, the first punch (15) includes axially protruding edge portions which serve to form recessed edge regions on the compact these edge regions serving to accommodate to a significant extent any beards formed.

According to a further embodiment of the present invention, the walls of the cavity are coated with a material having a low friction coefficient relative to the powder and which is able to withstand repeated use.

According to a preferred embodiment of the present invention, the coating is of a diamond-like carbon material.

According to a preferred embodiment of the present invention, less than 0.5, or more preferably, less than 0.4 weight % of lubricant is included in the powder to be moulded into a compact.

According to a particularly preferred embodiment of the present invention, the powder includes about 0.3% weight of lubricant when the die cavity walls are coated as mentioned above.

It is preferred that the green density of the compact prior to sintering is at least 7.4 g/cc, It has been found that the present invention can in the case of steel powder, achieve, by a cold, single pressing/sintering of a mixture of metal powders and significantly reduced amount of lubricant, a final density of at least 7.5.

THE DRAWINGS

Figure 3:
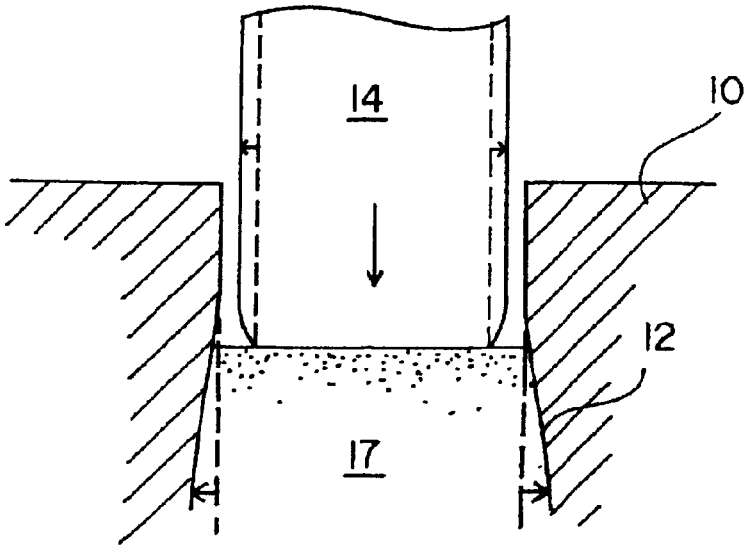
Figure 4A:
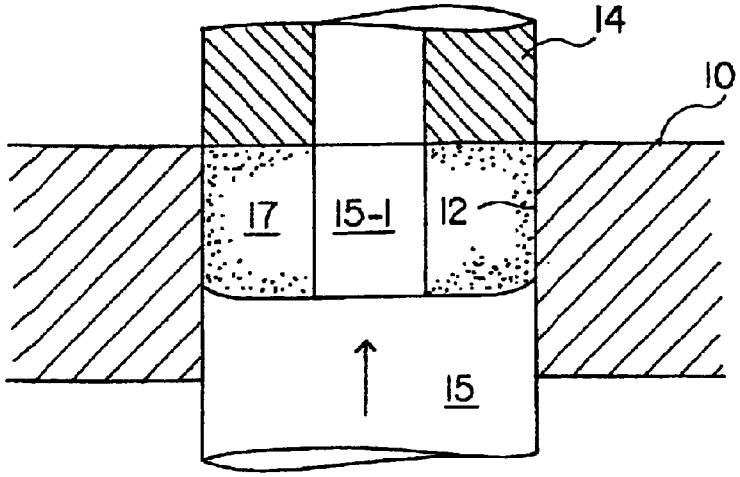
Figure 4B:
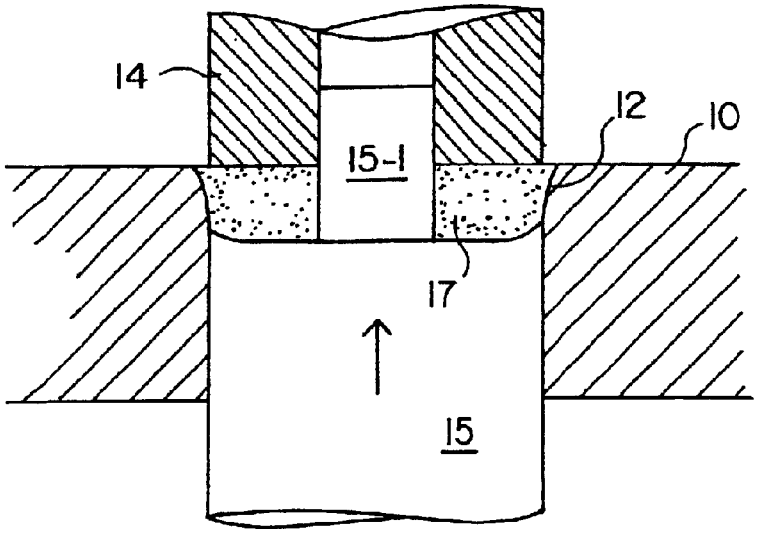
Figure 5:
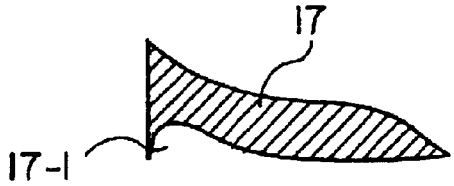

In order than the invention be better understood, particularly preferred embodiments of it will now be described, by way of example only, with reference to the accompanying Figures, which are as follows:

FIGS. 1A to 1C, (previously described) show a conventional tool for metal powder compression, at three steps of a compression process;

FIG. 2, (also previously described) illustrates on an enlarged scale the deformations of the tool during a compression operation;

FIG. 3 further illustrates on an enlarged scale the deformation of a tool according to the present invention during a compression operation;

FIGS. 4A and 4B show a tool according to the present invention at two stages of a compression operation; and FIG. 5 shows an enlarged view of one edge of a compact obtained using the tool of FIGS. 4A and 4B.

DETAILED DESCRIPTION

In the interests of clarity the relative deformations have been exaggerated to make them more visible. In practice they are very small but significant.

In FIG. 3, the nominal shapes of punch 14 and of stamp 12 are illustrated by dotted lines. According to the present invention, the dimensions of the tool are chosen so that the clearance between moving punch 14 and die 10 is relatively large with respect to the clearance of a conventional tool illustrated in FIG. 2. More specifically, as illustrated, this clearance is greater than the maximum radial expansion reached by punch 14 at the desired maximum compression pressure. However, this clearance is selected to be not greater than a limit at which the powder escapes from the die, This limit reaches 100 μm for commonly used metal powders, and it is greater than the mean grain size of the powder, because the grains tend to jam together in the clearance, as mentioned earlier.

In practice, the clearance is chosen according to the diameter of the compact. For example, good results are obtained by choosing a clearance of 50 μm for diameters reaching 50 mm, a clearance of 60 μm for diameters between 50 and 80 mm, and a clearance of 80 μm for clearances above 80 mm.

By choosing such a clearance the punch and die will undergo much less distortion as compared to the conventional tool of FIG. 2 and will successfully operate at higher pressures. A tool according to the present invention has been successfully tested at more than 1050 MPa. Further, since the contact areas are of smaller extent and the effects of friction are lower, the wall of cavity 12 maintains an acceptable surface finish for a longer period of time in service.

Preferably, the largest practicable clearance is chosen for all the tool elements. Indeed, these elements are generally designed to be movable one with respect to, another during use so as to promote homogenisation within the compact. Further, assembly of the tool is thus facilitated by having the largest practicable clearance.

It will be noted that the existence of the preferred relatively large clearance between punch and die inevitably causes the forming of beards. One might expect that the beard produced by a tool according to the present invention would be bigger, and thus more unacceptable, than that produced by conventional low or tight clearance tools. In fact the beard produced by a tool according to the present invention is wider than that produced by a conventional tool, but it is not taller. It is mostly the height of beards which in unacceptable. The beards obtained on the compacts produced by means of a tool according to the present invention may be removed or otherwise processed conventionally.

If a tool according to the present invention is used under above normal pressure, in the way described in relation with FIGS. 1A to 1C, compact 17 will exhibit greater barrel deformation than in a conventional case. As a result, compact 17 would be more difficult to eject and more lubricant would accordingly be required, which militates; directly against the desired increase in density.

FIGS. 4A and 4B illustrate a particularly preferred form of tool according to the present invention, minimising this problem. The moving punch is in this case the lower punch 15 which is provided with an upwardly extending broach portion 15-1. This co-operates with a corresponding recess in the upper punch 14 to make a recess or opening in a compact 17 to be compressed.

In FIG. 4A, lower punch 15 is, as in FIG. 1A, set at a specific position which determines the volume of powder contained by cavity 12. This cavity 12 is filled flush with the upper surface of die 10. Then, upper punch 14 is lowered to seal the cavity 12, if necessary by slightly penetrating into the latter. The compression operation is then performed at the top of the die by appropriately combining relative motions of the punches and of the die.

In FIG. 4B, punch 15 has reached its final position, as determined by the pressure applied to it.

As previously, the compression of compact 17 generates radial force which deform die 10. However, since compact 27 is then positioned towards one face of the die, the walls of cavity 12 do not deform as a barrel but, as illustrated, as an upwardly opening cone. This conical shape is partially retained when punch 14 is raised, which considerably helps the ejection of compact 17 by lower punch 15.

Using the concepts of this invention, the proportion of lubricant may be smaller than 0.5 weight %. The combination of this reduction in the proportion of lubricant and of the increase in the compression pressure, up to approximately 1050 MPa, produced final product densities in excess of 7.5 (based on steel powder).

Even less lubricant, about 0.3 weight %, may be used when the walls of the die cavity 12 are coated with a material having a low friction coefficient with the powder. This material should, as previously mentioned, withstand repeated forces caused by successive compression operations. A material which meets these requirements is DLC (Diamond Like Carton).

The punch edges, as is shown in FIGS. 4A and 4B for lower punch 15, preferably slightly protrude axially because this has been found to attenuate beard formation.

FIG. 5 shows an enlarged and deliberately exaggerated view of an edge of compact 17 obtained with such an arrangement. The edge of compact 17 is indented with respect to the lower surface, so that beard 17-1 resulting from the clearance is entirely included within this indentation. Thus, beard 17-1 does not affect the technical function of the corresponding surface of the compact, if this surface is not subsequently machined.

Various alterations and modifications of the present invention will readily occur to those skilled in the art. For example, it is not required to compress a compact right at or closely adjacent one surface of the die cavity, as shown in FIGS. 4A and 4B, if this compact already has a tapered shape facilitating its ejection. The compact may then be formed at the middle of the die cavity, as shown in FIG. 1B, while applying the higher pressures useable according to the present invention, with a reduced amount of lubricant

What is claimed is:

1. A single press, single sinter process for the production of sintered articles from powdered metal by pressing to form a compact which is thereafter sintered, characterized in that a powder mix having from about 0.3 to 0.5 weight % of a solid lubricant is pressed in a single step in a die having a working clearance of at least 45 μm under a pressure of at least 800 MPa, to form a compact for subsequent sintering, wherein the working clearance is less than a mean grain size of the powder.

2. A process according to claim 1 wherein the lubricant content of the powder is less than about 0.4% by weight.

3. A process according to claim 1 wherein the lubricant content of the powder is about 0.3% by weight.

4. A process according to claim 1 wherein the metal is steel and the final sintered density after pressing and sintering is at least 7.5 g/c.

5. A process according to claim 1 wherein the die clearance is in the range 45 to 100 μm.

6. A process according to claim 1 wherein the density of the compact prior to sintering is at least 7.4 g/cc.

7. Metal powder compression tool for forming compacts for sintering comprising at least a first punch adapted to compress in a single step metal powder mix having from 0.3% to 0.5% of a solid lubricant located in a cavity of a die, characterized in that the clearance between the at least first punch and the die is greater than 45 μm and less than a mean grain size of the powder.

8. The compression tool of claim 7, wherein the clearance is greater than 45 μm but less than 100 μm.

9. The compression tool of claim 7, wherein the clearance is about 50 μm for a compact up to about 50 mm in diameter.

10. The compression tool of claim 7, wherein the clearance is about 60 μm for compacts having a diameter in the range 50–80 mm.

11. The compression tool of claim 7, wherein the clearance is about 80 $\mu$m far compacts having a diameter above 80 mm.

12. The compression tool of claim 7, wherein the first punch and die are arranged to form the compact in the cavity flush with one surface of the die.

13. The compression tool of claim 12, including a second punch cooperating with the die on a side opposite to the first punch, the second punch, during a compression, being arranged to seal the cavity in the vicinity of the die surface, the first punch being operative to eject the compact at the end of the compression.

14. The compression tool of claim 13, wherein the first punch includes axially protruding edges for forming recessed edge regions on the compact to accommodate beard formation.

15. The compression tool of claim 7, wherein the die has walls that are coated with a material having a low friction coefficient relative to the metal powder which is to be compressed and which is able to withstand repeated compression operations.

16. The compression tool of claim 15, wherein the coating is diamond-like carbon.

* * * * *

UNITED STATES PATENT AND TRADEMARK OFFICE

CERTIFICATE OF CORRECTION

PATENT NO. : 6,558,144 B1
DATED : May 6, 2003
INVENTOR(S) : Gueydan et al.

It is certified that error appears in the above-identified patent and that said Letters Patent is hereby corrected as shown below:

Column 6,
Line 49, after “at least” delete “g/c.” and insert therein -- g/cc. --

Column 7,
Line 2, after “80 um” delete “far” and insert therein -- for --.

Signed and Sealed this

Twenty-seventh Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,558,144 B1
DATED : May 6, 2003
INVENTOR(S) : Gueydan et al.

It is certified that error appears in the above-identified patent and that said Letters Patent is hereby corrected as shown below:

Column 1,
Line 52, replace word “produce” and insert therein -- product. --.

Column 6,
Line 13, after “Like” delete “Carton” and insert therein -- Carbon). --

Signed and Sealed this

Third Day of August, 2004

JON W. DUDAS
*Acting Director of the United States Patent and Trademark Office*